US010840041B1

(12) United States Patent
Harms

(10) Patent No.: US 10,840,041 B1
(45) Date of Patent: Nov. 17, 2020

(54) MULTIFUNCTIONAL CONTROL ELEMENT

(71) Applicant: Ableton AG, Berlin (DE)

(72) Inventor: Oliver Harms, Bestensee (DE)

(73) Assignee: Ableton AG, Berlin (DE)

( * ) Notice: Subject to any disclaimer, the term of this patent is extended or adjusted under 35 U.S.C. 154(b) by 0 days.

(21) Appl. No.: 16/720,359

(22) Filed: Dec. 19, 2019

(51) Int. Cl.

| | |
|---|---|
| ***H01H 25/04*** | (2006.01) |
| ***H01H 25/06*** | (2006.01) |
| ***G05G 9/02*** | (2006.01) |
| ***G05G 5/04*** | (2006.01) |
| ***G05G 5/05*** | (2006.01) |

(52) U.S. Cl.
CPC ..... *H01H 25/06* (2013.01); *G05G 5/04* (2013.01); *G05G 5/05* (2013.01); *G05G 9/02* (2013.01); *H01H 25/04* (2013.01); *G05G 2505/00* (2013.01); *H01H 2215/034* (2013.01); *H01H 2239/006* (2013.01)

(58) Field of Classification Search
CPC .... H01H 25/008; H01H 25/041; H01H 25/06; H01H 2025/043; H01H 2223/05; H01H 3/162; H01H 25/00; H01H 25/002; H01H 2025/045; H01H 2025/048; H01H 25/04; H01H 25/006; H01H 25/065
See application file for complete search history.

(56) References Cited

U.S. PATENT DOCUMENTS

| | | | | |
|---|---|---|---|---|
| 6,812,415 | B1 * | 11/2004 | Priesemuth | H01H 3/20 200/5 R |
| 2001/0004044 | A1 * | 6/2001 | Sotome | H01H 25/00 200/5 R |
| 2005/0040018 | A1 * | 2/2005 | Gotoh | G05G 5/03 200/17 R |
| 2008/0257701 | A1 * | 10/2008 | Wlotzka | H01H 25/008 200/336 |
| 2011/0308927 | A1 * | 12/2011 | Yang | H01H 25/041 200/5 A |

FOREIGN PATENT DOCUMENTS

| | | | |
|---|---|---|---|
| DE | 102004035078 | A1 | 3/2005 |
| DE | 102008061577 | B4 | 6/2010 |
| EP | 1619706 | B1 | 9/2009 |
| EP | 2447971 | B1 | 5/2012 |

* cited by examiner

*Primary Examiner* — Ahmed M Saeed
(74) *Attorney, Agent, or Firm* — Chernoff Vilhauer LLP

(57) ABSTRACT

A multifunctional control element is disclosed, comprising a rotary knob which is rotatably mounted on a radial bearing with a radial bearing mount, and which is connected to a rotary sensor for creating signals related to rotary direction and rotary speed of the rotary knob; a rotary knob mount which receives the rotary knob, as well as the radial bearing and the radial bearing mount, and which is pivotable around a shaft mounted to a mounting plate, wherein a switch is provided on the mounting plate for creating signals related to downward displacement of the rotary knob mount with the radial bearing; and at least one linear bearing provided on the shaft for permitting sliding displacement of the rotary knob mount with the radial bearing along the shaft, wherein switches are provided on the mounting plate for creating signals related to the sliding displacement of the rotary knob mount.

13 Claims, 4 Drawing Sheets

MULTIFUNCTIONAL CONTROL ELEMENT

FIELD OF THE INVENTION

The present invention is directed to control elements, in particular control elements which offer wide-ranging functionalities for electronic devices, e.g. musical instruments.

BACKGROUND OF THE INVENTION

Control elements which allow for several functions, can be found in diverse fields of technology, e.g. computers, automobiles, musical instruments and many more.

Typically, such control elements have large rotary knobs with movable additional functions, but often suffer from weaknesses in their stability, due to their complicated construction. The higher the degree of freedom (meaning mechanically independent displacement directions), the more wobbly or instable these rotary knobs become, with respect to their tilting directions or, respectively, displacement directions around their rotation axis. The main reason for this is that rotary knobs are usually fixed onto a center axis which is additionally moveable axially downwardly, if pressure switch functions are included. If the control elements have further mechanical degrees of freedom (displacements upward/downward/left/right) apart from the pressure switch function, then this is usually done with the help of a movable inclinable axis which allows for additional tilting functions in the respective directions (joy stick). All elements that allow for displacements, such as the tilting and downwardly moveable centre axis, on which the rotary knob or, respectively, the knob surface are mounted and which permits the additional mechanical degrees of freedom (right/left/upward/downward displacement) as well as the tilt function, result in this kind of rotary knob being wobbly or, respectively, instable, particularly in its resting or, respectively, center position—something which is not desired. Moreover, a pressure switch function, e.g. the simple downward push, is often only usable with restrictions, as such a rotary knob with a pressure switch function only provides for sensible haptic features (click feel, click torque) in the center of the big knob surface (directly above the rotation axis), while in the off-center area of a big knob a downward push is difficult to impossible, as the downward movable rotation axis can get locked in its shaft (socket) due to the push, if the application of force does not occur axially to the rotation axis. With respect to such control elements, there are, thus, two types of problems, namely a certain instability on the one hand and a bad or, respectively, inexact controllability on the other, when it comes to the accuracy of the input implementation. In addition, these control elements often have a significantly shorter durability due to the instability mentioned above.

DE 10 2004 035 078 A1 discloses a switch which can pivot from its neutral position, as well as a cap which can slide which, in turn, is made possible by a pivot element. This switch does not have a rotary element, such as, for instance, a potentiometer or an encoder. For this reason, the cap cannot be rotated. This limited functionality is therefore not sufficient for some applications.

DE 10 2008 061 577 B4 discloses a multifunctional control device which can be rotated, tilted downward and pivoted to both sides with a pivot element. Moreover, this device has a snap element for the rotation axis. Yet, this multifunctional control device does not have any linearly movable elements. This limited functionality is therefore also not sufficient for some applications.

EP 1 619 706 B1 discloses a controller device with a rotary-push-button switch and a linear-displacement device which is developed as a gliding device. The main emphasis is put on offering different functions based on the position of a rotary knob in a defined displacement field which is why sensors are provided to sense the X-Y-position of the rotary-push-button in its displacement field. However, the gliding device does not provide for an exact bearing and therefore comes with a certain instability, on the one hand, and a bad or, respectively, inexact controllability on the other.

EP 2 447 971 B1 discloses a displacement unit which resembles the one described above in its inexact bearing; specifically the bearing has not been realized by a guiding along an axis. The device therefore also comes with a certain instability, on the one hand, and a bad or, respectively, inexact controllability on the other.

Hence, there continues to be a need for a control element which overcomes the disadvantages described above.

SUMMARY OF THE INVENTION

Thus, it is an object of the present invention to provide a control element, in particular for electronic musical instruments which offers diverse functionalities, is easy to operate and offers a more exact implementation of inputs, as well as a longer durability.

According to the invention, this has been achieved with a multifunctional control element according to claim 1 which comprises a rotary knob which is rotatably mounted on a radial bearing with a radial bearing mount and which is connected to a rotary sensor for creating signals related to the rotary direction and the rotary speed of the rotary knob; a rotary knob mount which receives the rotary knob, as well as the radial bearing and the radial bearing mount, and which is pivotable around a shaft mounted to a mounting plate, wherein the shaft extends in a direction parallel to the plane of the mounting plate and wherein the plane of the mounting plate extends vertically to the rotation axis of the rotary knob, which permits a pivoted downward displacement of the rotary knob mount with the rotatably mounted rotary knob is mounted thereon with the radial bearing, wherein a switch is provided on the mounting plate for creating signals related to the downward displacement of the rotary knob mount with the rotary knob mounted thereon; and at least one linear bearing provided on the shaft for permitting a sliding displacement of the rotary knob mount and the rotary knob mounted thereon with the radial bearing along the shaft, wherein switches are provided on the mounting plate for creating signals related to the sliding displacement of the rotary knob mount and the rotary knob mounted thereon with the radial bearing.

Other advantageous features of the control element of the present invention are disclosed in the dependent claims.

DESCRIPTION OF THE PREFERRED EMBODIMENTS

The present invention is directed to a multi-functional control element, particularly for electronic musical instruments, with a rotary knob which offers additional degrees of freedom with regard to displacement apart from the rotary displacement and, thus, further electrical features or, respectively, functions, most notably

- a push function, i.e. a depression of the rotary knob whereby a switching process is triggered or, respectively, a switching signal is created which is made available for further processing, and
- a sideward push (slide) of the rotary knob in a direction in a plane vertically to the rotation axis, whereby likewise switching processes are triggered or, respectively, switching signals are created which are made available for further processing, as well as optionally

- a capacitive touch function, i.e. a capturing whether a finger touches the knob, wherein the touch triggers an electric signal which is made available for further processing,
- a measurement of the applied force exerted to push the knob downward, wherein this force-sensor-information is also made available for further processing, and
- an electrically connectable snap element as a further mechanical function.

Figure 1:
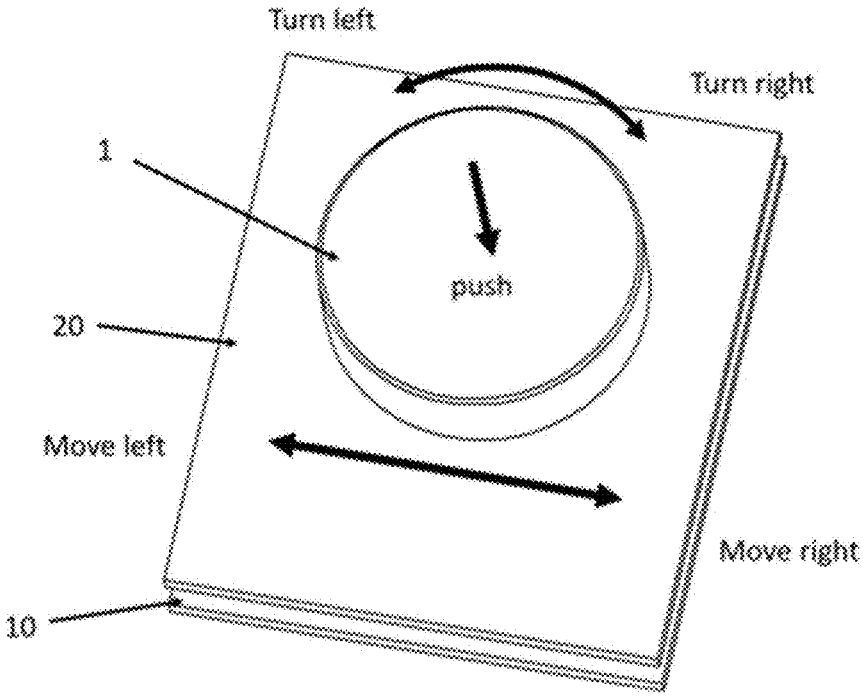
FIG. 1 shows the control element of the present invention diagonally from above.

FIG. 1 shows the fundamental degrees of freedom of the control element of the present invention, i.e, rotating left or right around the rotation axis of the rotary knob, depressing (push function) and sideward sliding.

As mentioned above, conventional control elements have, amongst others, the disadvantages of being instable, being controllable only in a limited way or, respectively, in an inexact way and often being less durable. The present invention overcomes these problems by the execution of the above-described displacements by means of the construction according to the present invention.

Modules and Components

The multifunctional control element of the present invention is generally comprised of four primary module units, specifically

- a module A, comprising
  - (i) a rotary knob and
  - (ii) a rotary knob displacement element;
- a module B, comprising
  - (iii) a rotary knob mounting element;
- a module C, comprising
  - (iv) a mounting plate with
  - (v) switches to sense sideward and downward displacements;
- a module D, comprising
  - (vi) a mounting plate with
  - (vii) a sensor element to sense the rotary displacement.

Figure 2:
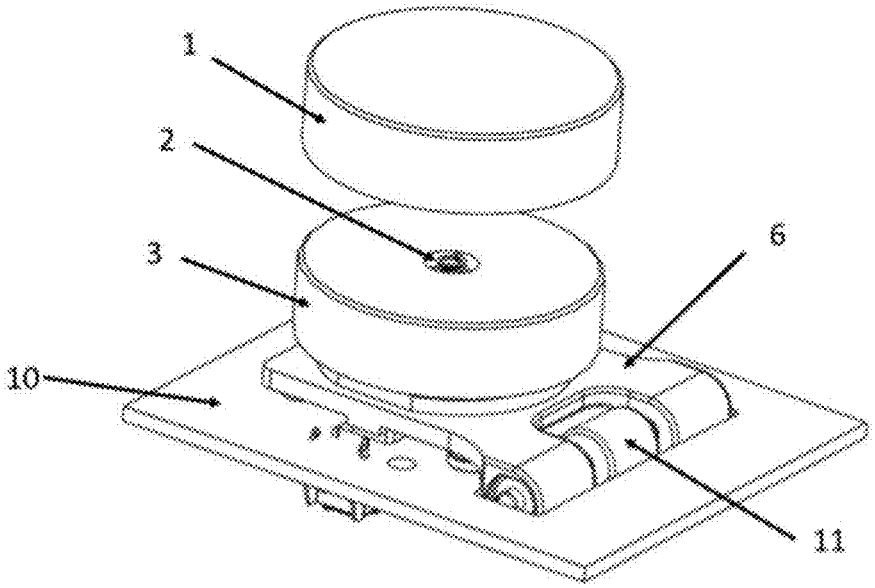
FIG. 2 shows the control element of the present invention with the rotary knob cap removed.
Figure 3:
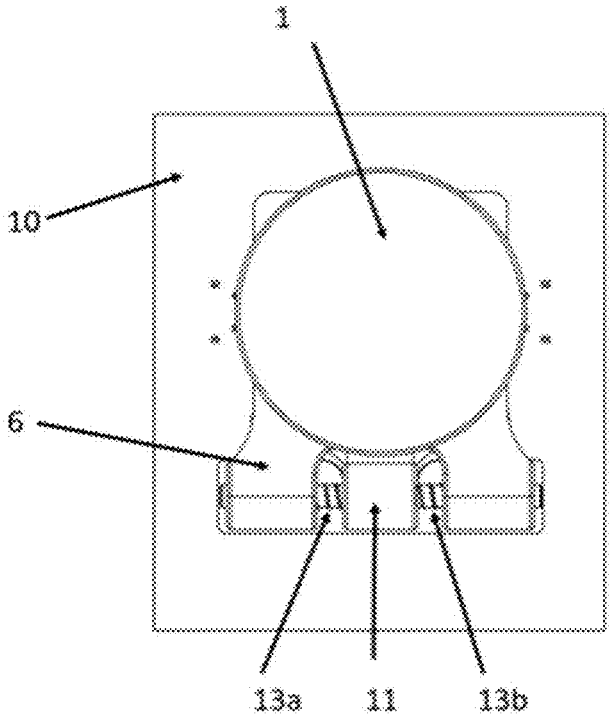
FIG. 3 shows a front view of the control element of the present invention.

FIGS. 2 and 3 show the basic construction of the control element of the present invention by means of some components of the above modules, namely

- (i) the rotary knob cap 1, the contact spring 2 and the rotary knob core 3 of the rotary knob of module A;
- (ii) the rotary knob mount 6 of the rotary knob displacement element of module A;
- (iii) the hinge mount 11 and the springs 13*a*, 13*b* of the rotary knob mounting element of module B;
- (iv) the mounting plate 10 of module C.

The elements of module D are located below the rotary knob cap 1 or, respectively, the mounting plate 10.

Figure 4:
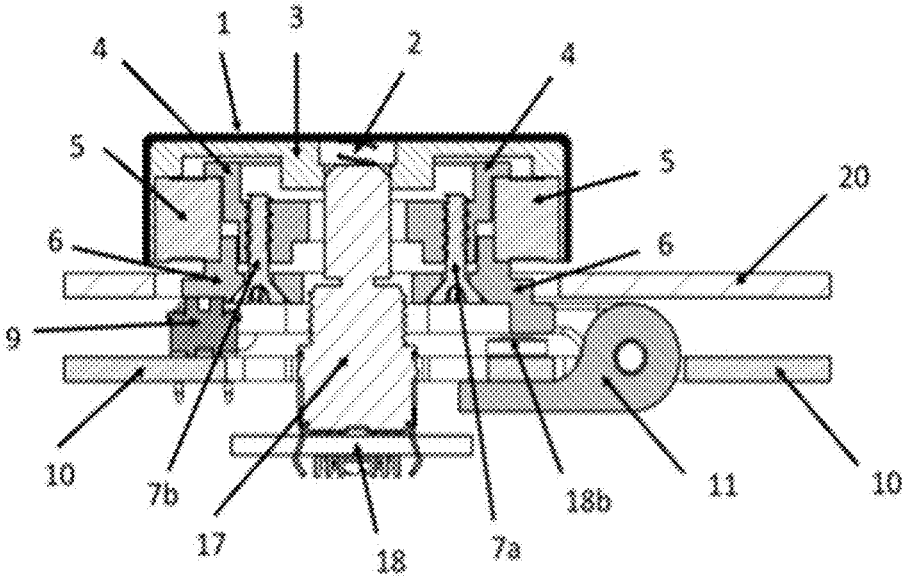
FIG. 4 shows a vertical cross-section from the side of the control element of the present invention.
Figure 5:
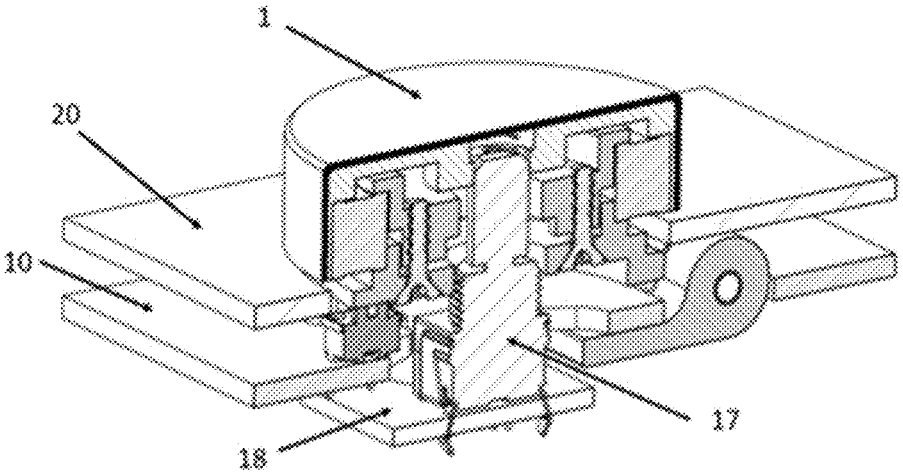
FIG. 5 shows the control element of the present invention in a vertical cross-section in a diagonal view.

The detailed construction and functions of preferred embodiments of the control element of the present invention are further described below. Firstly, the additional elements of the respective module components shall be mentioned:

(i) Apart from the rotary knob cap 1, the contact spring 2 and the rotary knob core 3, the rotary knob of module A furthermore comprises a radial bearing mount 4 and a radial bearing 5 (FIG. 4).

Figure 7:
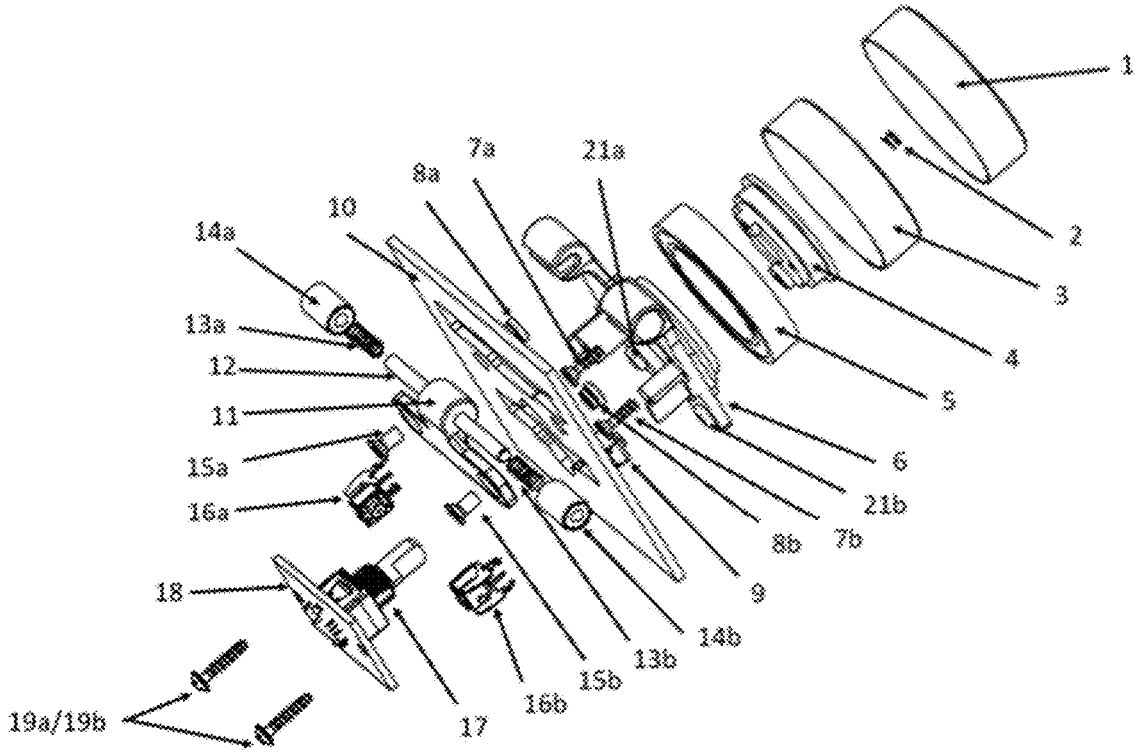
FIG. 7 shows an exploded view of the control element of the present invention.

(ii) Apart from the rotary knob mounting plate 6, the rotary knob displacement element of module A furthermore comprises fixing elements 7*a*, 7*b* and displacement limiting elements 21*a*, 21*b* (FIGS. 4 and 7).

Figure 6:
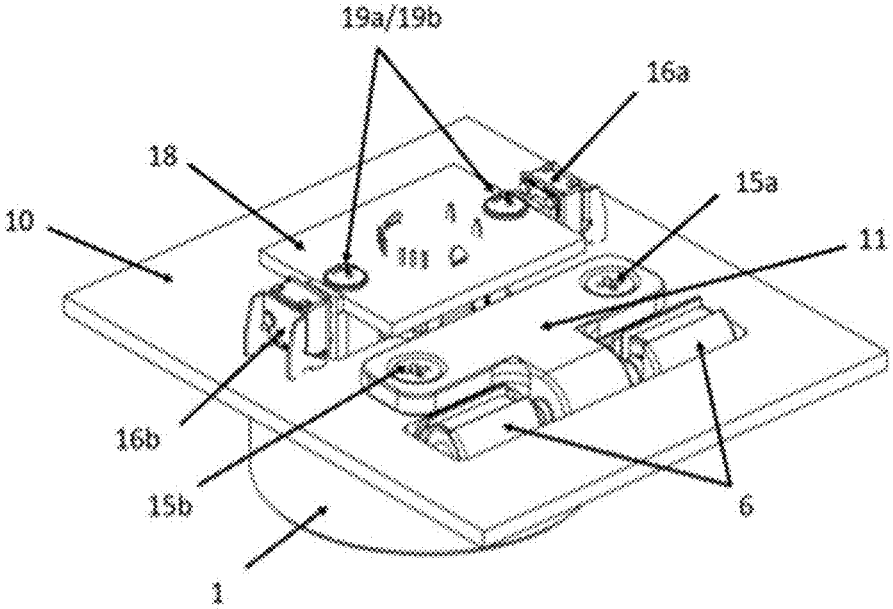
FIG. 6 shows the control element of the present invention diagonally from below.

(iii) Apart from the hinge mount 11 and the springs 13*a*, 13*b*, the rotary knob mounting element of module B comprises mounting elements 8*a*, 8*b*, 15*a*, 15*b*, a shaft 12 and a radial bearing 14*a*, 14*b* (FIGS. 6 and 7).

(iv/v) The switches on mounting plate 10 of module C comprise switches 9 and 16*a*, 16*b* (FIGS. 4 and 6).

(vi/vii) The sensor element on mounting plate 18 of module D comprises a rotary sensor 17 and fixing elements 19*a*, 19*b* (FIGS. 4 and 6).

In general, the control element is embedded in a housing plate 20 (FIGS. 1 and 4).

In another embodiment, the rotary knob can additionally be arranged capacitive-touch-sensitive. Moreover, in yet another embodiment, an additional device or sensor, respectively, to measure the force applied during the push can be provided. Finally, in yet another embodiment, an additional snap element can be provided.

Construction

Module A

As can be seen in the exploded view in FIG. 7, the radial bearing 5 is fixed onto the rotary knob mount 6 by the radial bearing mount 4 (this may be a ball bearing) and the fixing elements 7*a*, 7*b* which can, for instance, be screws. The radial bearing 5 has the rotary knob core 3 fitted thereon, which, in turn, has the the rotary knob cap 1 fixed thereon, which can be realized by pressing or fitting or any other method that allows for a solid connection. Furthermore, displacement limiting elements 21*a*, 21*b* are provided to limit the rotary knob's downward displacement.

Module B

Furthermore, as can been seen in the explosive view in FIG. 7, shaft 12 which is preferably made from metal, extends outwardly from the hinge mount 11 which is fixed onto the mounting plate 10, wherein the shaft 12 extends in a direction parallel to the plane of the mounting plate 10 and wherein the plane of mounting plate 10 lies vertically to the rotary knob's rotation axis. The fixture of hinge mount 11 (and hence that of shaft 12) on the mounting plate 10 is realized by mounting elements 8*a*, 8*b* and 15 *a*, 15*b* which can be, for instance, threaded nuts or screws. The mounting plate 10 can also be an electronic circuit board. On the shaft 12, springs 13*a*, 13*b* are provided, preferably also made from metal, which serve the function to center-position the rotary knob mount 6 along shaft 12, as well as the linear bearings 14*a*, 14*b* which are slid onto shaft 12 and which may also be ball bearings.

Module C

Furthermore, as can be seen in the explosive view in FIG. 7, switch 9 for sensing the downward displacement of the control element (as further described below), as well as switches 16*a*, 16*b* for sensing its sideward displacement (also further described below) are located on the mounting plate 10. These switches can be tact switches, for instance.

Module D

Furthermore, as can be seen in the explosive view in FIG. 7, the mounting plate 18 with rotary sensor 17 thereon is fixed onto the rotary knob mount 6 by fixing elements 19*a*, 19*b* which can, for instance, be screws. Encoders such as, for instance, mechanic, conductive, resistive, magnetic, inductive or optic encoders, can be a rotary pulse encoder.

Touch-Sensitive Add-on

As mentioned above, in an additional embodiment the rotary knob can be designed also in a capacitive-touch-sensitive manner. To this end, rotary cap 1 and contact spring 2 are designed to be electrically conductive. The electrically conductive spring 2 allows for an electric connection between the rotary knob cap 1 and the shaft of rotary sensor 17.

Complementary Pressure Sensing

Figure 8:
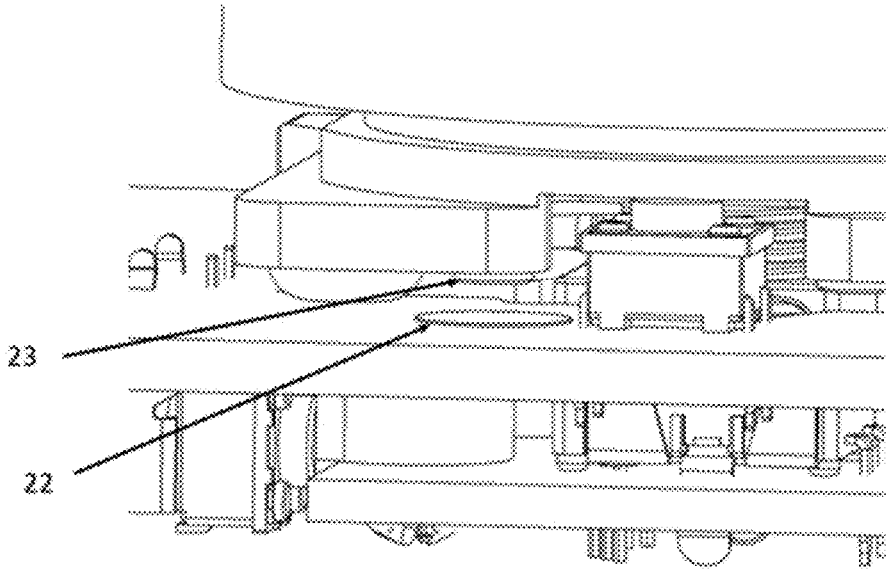
FIG. 8 shows an enlarged view of a part of the control element of the present invention from the side.

Moreover, in yet another embodiment an additional device or, respectively, sensor can be provided to measure the force applied with the downward push of the rotary knob, wherein the sensor comprises a sensing element 22, as well as a transfer element 23 (FIG. 8).

This can be an inductive, capacitive or magnetic sensor, wherein the sensor measures the distance between the sensing element 22 and the transfer element 23 which is preferably located above the sensing element 22. In addition, the displacement limiting elements 21*a*, 21*b* can be elastic and an elastic contact element can be provided at the switch 9 to measure an increase in force due to a compression of these elastic elements which can be caused, for instance, by a further downward push of the rotary knob. To this end, the displacement limiting elements 21*a*, 21*b* should be preferably made of a rubber-like material, for instance, silicone which has a spring effect or, respectively, is compressible. As shown in FIG. 8, the sensing element 22 and the transfer element 23 can be located on the mounting plate 10 or, respectively, the rotary knob mount 6, but other suitable mounting positions are also possible.

Complementary Snap Element

In yet another embodiment, wherein encoders are used as rotary pulse encoders which do not have their own snap element, an electrically connectable snap element can be provided via an actuator (solenoid actuator as a latch version), through which a certain amount of steps per rotation becomes tactilely perceptible at the time when the rotary knob is being rotated. This snap element is solely mechanic and can be independent from the actual electric step sequence, i.e. the electric amount of steps per knob rotation. The snap element comprises at least one ball, preferably made of steel, which resiliently engages a snap contour and which is guided in a sleeve. The at least one snap ball resiliently engages a snap contour. The snap contour is provided with a plurality of snap positions formed as recesses and/or protrusions. The at least one guided ball snaps through the active springs guided in sleeves. The snap contour can have the form of a disk or cylinder, wherein the snap recesses and protrusions are provided along the circumference of the inner or outer side. The snap element can be provided on the shaft of the rotary sensor 17 and the mounting plate 18.

Functions

Rotary Function

The rotation of the rotatably mounted rotary knob which is connected to the rotary sensor 17 creates signals at the rotary sensor 17 related to the rotary direction and rotary speed of the rotary knob and can be used for diverse functions. With these signals, an interaction with, for instance, device software can be achieved, e.g. an upward or downward navigation (scrolling). Additionally, other functions can be controlled such as, for instance, filter settings, volume control, as well as context dependent functions etc. In principle, every sensible device function can be controlled with the rotary function inside the device software (mapping).

Push Function

The rotary knob mount 6 which holds the rotatably mounted rotary knob and which is pivotable around the shaft 12 mounted on the mounting plate 10 allows for a tilted downward displacement of the rotary knob mount 6 with the rotatably mounted rotary knob through a downward push of the rotary knob. The downward push triggers switch 9, whose signals can be used for diverse functions, for instance, a previously chosen (for instance, by having used the rotary function described above) element on the display can be elected or, respectively, confirmed. Furthermore, it is possible to start or, respectively, stop sequences in their process. In principle, every sensible device function can be controlled with the push function inside the device software (mapping).

Sideward Sliding Function

The sideward sliding of the rotary knob mount 6 with the rotary knob mounted thereon with the radial bearing along the shaft 12 results in triggering the switches 16*a*, 16*b*, whose signals can be used for diverse functions, for instance, forward and backward browsing through pages. In principle, every sensible device function can be controlled with the sideward sliding function inside the device software (mapping).

Capacitive Touch Function

If the appropriate methods are used, a capacity change on rotary sensor 17, caused by the touch (e.g., of a finger) of rotary knob cap 1 can be measured due to the optional electrically conductive design of the rotary knob 1 and the contact spring 2 mentioned above, while the signals based thereon can be made available for further processing. Based on these signals, the pre-configured functions for the knob can be shown (for instance, on a display) for instance, at the time the knob surface is being touched. This way, it is possible to know which designated functions pertain to this knob, prior to any interaction with the knob (through rotating, pushing or sliding as described above). In principle, every sensible device function can be controlled with the touch function inside the device software (mapping).

Pressure Sensing Function

When pressure is applied to the rotary knob the applied pressure force is sensed by the pressure sensors 22, 23 and the respective signals can be made available for further processing. These signals can be used for musical purposes, for instance. It is, for instance, possible to play an audio sample prior to selecting an instrument with switch 9. This can happen in the following sequence: 1) instrument selection by scrolling and browsing through the database; 2)

pre-listening through applying enhanced pressure on the rotary knob; 3) selection of an instrument by a downward push of the rotary knob with triggering switch 9. In principle, every sensible device function can be controlled with the pressure sensing function inside the device software (mapping). As an optional add-on to this function, the optional elastically designed contact element on shaft 9 and the optional elastically designed displacement limiting elements 21*a*, 21*b* are compressed, while the rotary knob is pushed downward and switch 9 is triggered due to an increase in pressure. This allows the pressure sensor 22, 23 to measure an increase in force (after-touch function), additionally. The signals based thereon can also be used for musical purposes, for instance. This way, tones can be modulated or, respectively, changed in relation to the pressure force. In principle, every sensible device function can be controlled with this additional pressure function inside the device software (mapping).

Snap Function

When the rotary knob is rotated, the snap balls are firstly being deflected by the snap contour, opposite to the spring force, up to the center position, prior to snapping back at the next snap recess. It may be provided that the mechanic snap can be decoupled or, respectively, uncoupled from the snap contour through an electrically controlled magnet switch (solenoid), so that there will be no more mechanic snap during the rotation process.

The invention claimed is:

1. Multifunctional control element, comprising a rotary knob (1, 2, 3) which is rotatably mounted on a radial bearing (5) with a radial bearing mount (4), the rotary knob (1, 2, 3) being connected to a rotary sensor (17) for creating signals related to a rotary direction and a rotary speed of the rotary knob (1, 2, 3);

a rotary knob mount (6) which receives the rotary knob (1, 2, 3), as well as the radial bearing (5) and the radial bearing mount (4), the rotary knob mount (6) being pivotable around a shaft (12) mounted to a mounting plate (10), wherein the shaft (12) extends in a direction parallel to a plane of the mounting plate (10) and wherein the plane of the mounting plate (10) extends vertically to a rotation axis of the rotary knob (1, 2, 3) which permits a pivoted downward displacement of the rotary knob mount (6) with the rotary knob (1, 2, 3) mounted thereon with the radial bearing (5), wherein a switch (9) is provided on the mounting plate (10) for creating signals related to the downward displacement of the rotary knob mount (6) with the rotary knob (1, 2, 3) mounted thereon with the radial bearing (5); and at least one linear bearing (14*a*, 14*b*) provided on the shaft (12) for permitting a sliding displacement of the rotary knob mount (6) with the rotary knob (1, 2, 3) mounted thereon with the radial bearing (5) along the shaft (12), wherein switches (16*a*, 16*b*) are provided on the mounting plate (10) for creating signals related to the sliding displacement of the rotary knob mount (6) with the rotary knob (1, 2, 3) mounted thereon with the radial bearing (5).

2. Multifunctional control element according to claim 1, wherein springs (13*a*, 13*b*) are provided at the shaft (12) for permitting a centered positioning of the rotary knob mount (6) with the rotary knob (1, 2, 3) mounted thereon with the radial bearing.

3. Multifunctional control element according to claim 1, wherein displacement limiting elements (21*a*, 21*b*) are provided at the rotary knob mount (6) for limiting the downward displacement of the rotary knob mount (6) with the rotary knob (1, 2, 3) mounted thereon with the radial bearing.

4. Multifunctional control element according to claim 1, wherein the radial bearing (5) and/or the at least one linear bearing (14*a*, 14*b*) is a ball bearing.

5. Multifunctional control element according to claim 1, wherein the rotary knob (1, 2, 3) includes a rotary knob cap (1) and a contact spring (2), which are electrically conductive such that an electrical connection between the rotary knob cap (1) and a shaft of the rotary sensor (17) is obtained for creating signals related to a capacity change resulting from touching the rotary knob cap (1).

6. Multifunctional control element according to claim 1, wherein a sensor is provided for measuring a force exerted when pressing the rotary knob (1, 2, 3) downwards, wherein the sensor comprises a sensing element (22) and a transfer element (23).

7. Multifunctional control element according to claim 6, wherein the sensor is an inductive sensor, a capacitive sensor, or a magnetic sensor.

8. Multifunctional control element according to claim 6, wherein elastic displacement limiting elements (21*a*, 21*b*) are provided at the rotary knob mount (6) for limiting the downward displacement of the rotary knob mount (6) with the rotary knob (1, 2, 3) mounted thereon with the radial bearing, as well as an elastic contact element at the switch (9), for creating signals related to an increase in force resulting from a compression of the elastic displacement limiting elements (21*a*, 21*b*) and the elastic contact element at the switch (9).

9. Multifunctional control element according to claim 8, wherein the displacement limiting elements (21*a*, 21*b*) consist of silicone.

10. Multifunctional control element according to claim 1, wherein a snap mechanism is provided at a shaft of the rotary sensor (17) and at the mounting plate (10).

11. Multifunctional control element according to claim 10, wherein the snap mechanism comprises at least one ball which resiliently engages a snap contour, the at least one ball being guided in a sleeve, wherein a plurality of snap positions formed as recesses and/or protrusions are provided at the snap contour.

12. Multifunctional control element according to claim 11, wherein the snap contour is formed as a disc or cylinder, wherein the recesses and/or protrusions are provided along a periphery on an inner side or an outer side.

13. Multifunctional control element according claim 10, wherein the snap mechanism can be switched on mechanically via a magnet switch.

* * * * *